US011484157B2

(12) United States Patent
Nyanin

(10) Patent No.: US 11,484,157 B2
(45) Date of Patent: Nov. 1, 2022

(54) PORTABLE HAND WASHING DEVICE

(71) Applicant: Naa Darkoah Nyanin, Potomac, MD (US)

(72) Inventor: Naa Darkoah Nyanin, Potomac, MD (US)

( * ) Notice: Subject to any disclaimer, the term of this patent is extended or adjusted under 35 U.S.C. 154(b) by 10 days.

(21) Appl. No.: 17/110,173

(22) Filed: Feb. 16, 2021

(65) Prior Publication Data

US 2021/0274980 A1 Sep. 9, 2021

Related U.S. Application Data

(60) Provisional application No. 62/959,816, filed on Jan. 10, 2020.

(51) Int. Cl.
*A47K 1/02* (2006.01)
*A47K 10/22* (2006.01)
*A47K 5/12* (2006.01)

(52) U.S. Cl.
CPC ..... *A47K 1/02* (2013.01); *A47K 5/12* (2013.01); *A47K 10/22* (2013.01)

(58) Field of Classification Search
CPC . A47K 1/02; A47K 5/12; A47K 10/22; B65D 55/12
USPC ..... 4/638
See application file for complete search history.

(56) References Cited

U.S. PATENT DOCUMENTS 270,459 A * 1/1883 Milligan ..... A47K 1/02 312/228
374,822 A * 12/1887 Braunfeld ..... A47K 1/02 312/317.1
419,442 A * 1/1890 Hildreth ..... A47K 1/02 312/201
444,531 A * 1/1891 Greene ..... A47K 1/02 312/308
734,348 A * 7/1903 Muehl ..... A47K 1/02 312/228
772,108 A * 10/1904 Longstreth ..... A47K 1/02 122/18.1
921,166 A * 5/1909 Rowe ..... A47K 1/02 312/248
1,358,937 A * 11/1920 Curliss ..... A47K 1/02 4/628
5,029,724 A * 7/1991 Serio ..... B65D 55/14 292/205
5,301,376 A * 4/1994 Herbert ..... A47K 1/02 220/379
6,253,394 B1 * 7/2001 Goyette ..... E03C 1/01 4/626

(Continued)

*Primary Examiner* — Benjamin R Shaw

(57) ABSTRACT

The product is a Portable Hand Washing Device. It stands at approximately 59 inches in length and 25 inches in width from the bottom. The device stands as one unit, with an upper chamber which holds 5 gallons of clean water. The chamber for clean water is connected with a touchless faucet to activate the flow of the water which leads into a basin. The basin is connected with a tube to a pale underneath the unit which can hold 6 gallons of water and serves as a reservoir for the discarded water from the basin. There are two rolling wheels at the rear of the unit. There is a provision for liquid hand soap and paper towel dispenser.
The device is still under development. I intend to use the following slogans: "Clean Hands, Good Health!" and "Excellent Hygiene! Excellent Health!"

1 Claim, 1 Drawing Sheet

(56) References Cited

U.S. PATENT DOCUMENTS

| | | | | |
|---|---|---|---|---|
| 7,441,286 | B1 * | 10/2008 | Taylor Parker | A47K 1/02 280/652 |
| 7,802,327 | B1 * | 9/2010 | Moceri | A47K 1/02 4/619 |
| 8,082,611 | B1 * | 12/2011 | Marshall | A47K 1/02 239/146 |
| 8,844,069 | B1 * | 9/2014 | Harvey | A47K 1/02 4/625 |
| 10,271,691 | B1 * | 4/2019 | Boyle | A47K 1/02 |
| 2012/0102638 | A1 * | 5/2012 | Al-Mahnna | A47K 1/02 4/626 |
| 2012/0233769 | A1 * | 9/2012 | Song | A47K 1/02 4/625 |
| 2014/0047636 | A1 * | 2/2014 | Thwaites | A47K 1/02 4/647 |
| 2021/0321829 | A1 * | 10/2021 | Shell | A47K 1/02 |
| 2021/0401235 | A1 * | 12/2021 | Schomburg | A47K 5/1202 |
| 2022/0025625 | A1 * | 1/2022 | Roncadori | E03B 1/041 |

* cited by examiner

Portable Hand Washing Device Drawing

PORTABLE HAND WASHING DEVICE

PRODUCT SPECIFICATION

The product is a Portable Hand Washing Device which stands as one unit. Inside the unit has an upper chamber with a top cover which carries the clean water for hand washing. The clean water comes through a touchless faucet into a basin which is connected to a tube into a container, that has been strategically placed in the lower chamber of the unit to serve as a reservoir for discarded water.

The unit is equipped with a liquid hand soap and a paper towel dispenser. There are two rolling wheels at the rear bottom of the device to make it easier to move around. The device is still under development. I intend to use the following slogans: "Clean Hands, Good Health!" and "Excellent Hygiene! Excellent Health!"

Figure 1:
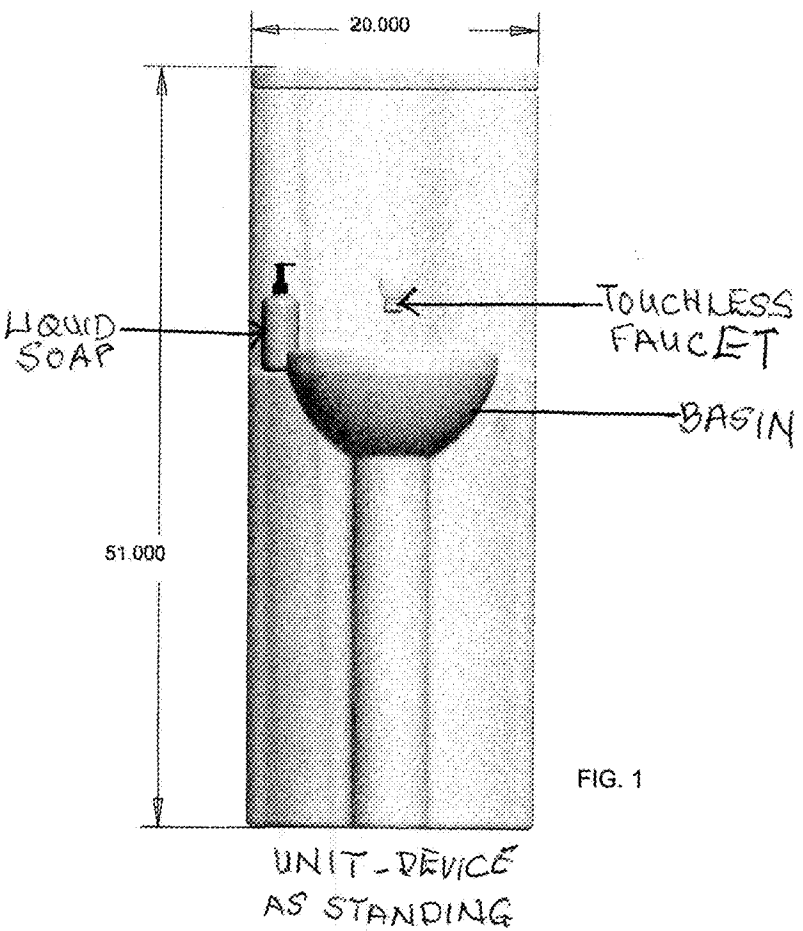

FIG. 1. is the drawing of the portable hand washing device, showing how it will look like after construction. It stands at approximately 59 inches in height from the ground and 20 inches in width from the top. The liquid soap will be placed on the space at the left side near the faucet. The little ball looking on top of the basin is the touchless faucet where the clean water will be dispensing from.

Figure 2:
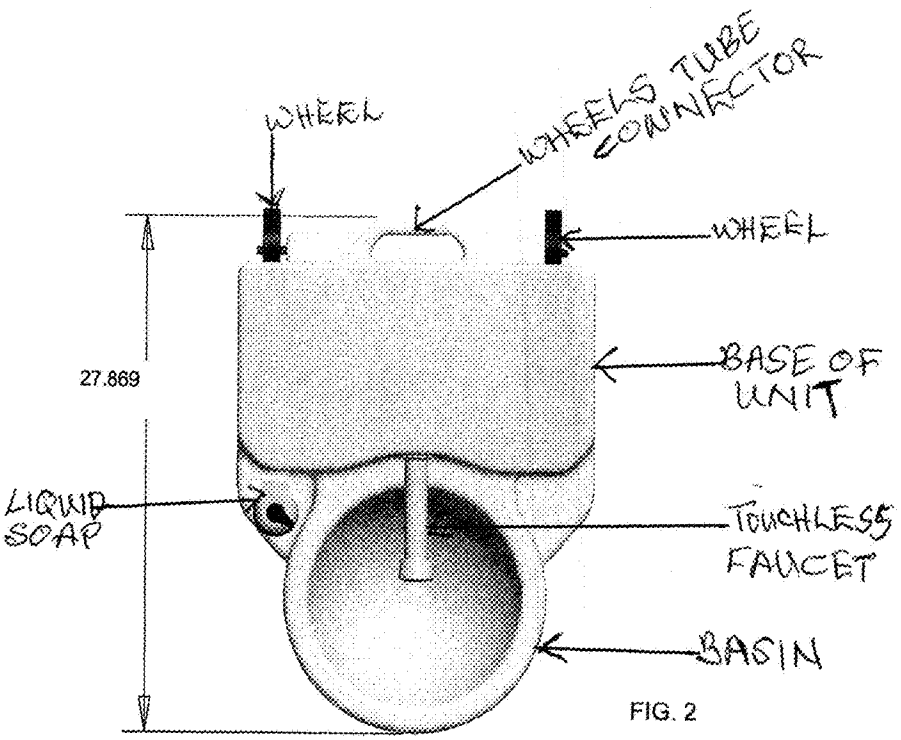

FIG. 2. is the drawing of the basin showing the height from the bottom of the wheels to the basin. This is approximately 28 inches tall. There is a tube connector showing how the 2 wheels will be connecting at the bottom of the unit. The base of the unit is labeled to clarify the drawing. The liquid soap is shown again on this FIG. 2. The object protruding in the middle of the basin is the touchless faucet. The basin which will be connected to a tube in the device to discard the dirty water after washing hands.

The invention claimed is:

1. A portable hand washing device that can be used to promote health and hygiene, the portable hand washing device comprising: one unit, in which there is an upper chamber which can hold 5 gallons of clean water, this chamber comes with a lid and a provision for a lock to secured the chamber against illegal tempering of the clean water, the device is equipped with a touchless faucet which activates the flow of clean water from the chamber, the touchless faucet dispenses the water for hand washing, attached is a basin projecting outwardly from the device and defining a front edge of the device that collects the dirty water which runs through a tube into a pale which is strategically placed underneath the unit to collect the dirty water, the pale can hold 6 gallons of water to avoid overflow, the pale also has a lid to avoid splashing of water underneath the unit, the device is also designed with an opening behind the unit to make it easier to discard the dirty water from the pale, this opening also has a cover to make the unit look attractive, there are two rolling wheels at the rear of the unit with a wheels tube connector extending between the wheels, a soap dispenser and a provision for paper towel holder.

* * * * *